US006562150B2

(12) United States Patent
Hiratani et al.

(10) Patent No.: US 6,562,150 B2
(45) Date of Patent: May 13, 2003

(54) STEEL SHEET FOR HEAT SHRINK BAND AND MANUFACTURING METHOD THEREOF

(75) Inventors: Tatsuhiko Hiratani, Fukuyama (JP); Hideki Matsuoka, Kasaoka (JP); Yasushi Tanaka, Fukuyama (JP); Reiko Sugihara, Fukuyama (JP)

(73) Assignees: NKK Corporation, Tokyo (JP); Sony Corporation, Tokyo (JP)

( * ) Notice: Subject to any disclaimer, the term of this patent is extended or adjusted under 35 U.S.C. 154(b) by 0 days.

(21) Appl. No.: 09/803,523

(22) Filed: Mar. 9, 2001

(65) Prior Publication Data

US 2002/0011282 A1 Jan. 31, 2002

Related U.S. Application Data

(63) Continuation of application No. PCT/JP00/05206, filed on Aug. 3, 2000.

(30) Foreign Application Priority Data

Aug. 11, 1999 (JP) ..... 11-228007

(51) Int. Cl.[7] ..... H01F 1/12
(52) U.S. Cl. ..... 148/306; 148/111; 148/120
(58) Field of Search ..... 148/306, 111, 148/120

(56) References Cited

U.S. PATENT DOCUMENTS 6,416,594 B1 * 7/2002 Yamagami et al. ..... 148/120

FOREIGN PATENT DOCUMENTS

| | | | |
|---|---|---|---|
| GB | 2322575 | * | 9/1998 |
| JP | 10-208670 A | | 8/1998 |
| JP | 11-158548 A | | 6/1999 |
| JP | 11-158549 A | | 6/1999 |
| JP | 11-286726 | * | 10/1999 |
| WO | WO01/07669 | * | 2/2001 |

* cited by examiner

*Primary Examiner*—John Sheehan
(74) *Attorney, Agent, or Firm*—Frishauf, Holtz, Goodman & Chick, P.C.

(57) ABSTRACT

A steel sheet for heat shrink band of the present invention has anhysteretic magnetic permeability of 15,000 or higher at 0.35 Oe and yield stress of 24 kgf/mm$^2$ or more. The steel sheet can be manufactured by a method comprising the steps of: hot rolling and/or cold rolling a steel containing 0.01 to 0.15% C by weight; annealing the rolled steel sheet at a temperature ranging from 650 to 900° C.; and temper rolling the annealed steel sheet at a rolling reduction rate of 1.5% or less. A CRT made of the steel sheet causes very little color deviation and practically no deformation of the panel surface.

14 Claims, No Drawings

STEEL SHEET FOR HEAT SHRINK BAND AND MANUFACTURING METHOD THEREOF

This application is a continuation application of International Application PCT/JP00/05206 (not published in English) filed Aug. 3, 2000.

TECHNICAL FIELD

The present invention relates to a steel sheet for heat shrink band which tightens the panel of cathode-ray tube (CRT) used in color television, computer monitor and the like, and to a manufacturing method of it.

BACKGROUND ART

Since CRTs are evacuated into a high vacuum of about $1\times10^{-}$Torr, the deformation of a panel surface and the internal explosion of a tube must be prevented. For this purpose, so-called heat shrinking treatment is executed in the following manner. That is, a heat shrink band composed of a steel sheet formed to a band shape is heated and expanded in the temperature range of about 400 to 600° C. for several seconds to several tens of seconds, put over the panel of a CRT, and then cooled and shrunk.

Further, since the heat shrink band has a function for shielding the geomagnetism similarly to the internal magnetic shield, it prevents the occurrence of landing error of electron beams on the surface of a fluorescent layer, that is, the occurrence of color deviation which is caused by the geomagnetism.

Conventionally, plated mild steel sheets have been used as a material of heat shrink band. However, since the magnetic permeability of the mild steel at the level of the geomagnetism (about 0.3 Oe) is about 200 so that it is not sufficient for the magnetic shielding performance, troublesome processes such as the adjustment of the position of a fluorescent layer, and the like are required in order to prevent the color deviation caused by the geomagnetism. Current CRTs have, therefore, an alternate current demagnetization circuit to improve the magnetic shielding performance.

Along with the increase in size of television screen in recent years, the heat shrink band is requested to have sufficient strength to prevent the deformation of a panel surface. To meet the requirement, the strength of steel sheet for heat shrink band has increased. The increase in strength, however, degrades the magnetic shielding performance, and the color deviation caused by geomagnetism has become more and more significant.

Japanese Patent Laid-Open No. 208670(1998) discloses a steel sheet for heat shrink band wherein both the strength and the magnetic performance are improved by adding 2 to 4% Si to a very low carbon steel of not higher than 0.005% C, and a manufacturing method of it.

However, when we actually applied the steel sheet for heat shrink band disclosed in Japanese Patent Laid-Open No. 10-208670 to color CRTs, a sufficient magnetic shielding performance could not be always obtained. Further, since the steel sheet contains much Si, the oxidized Si formed on the surface of a steel sheet contaminates the annealing line, and degrades the production yield.

DISCLOSURE OF THE INVENTION

An object of the present invention, which was made to solve these problems, is to provide a steel sheet for heat shrink band having a magnetic shielding performance capable of reliably preventing the color deviation and a strength enough for preventing the deformation of a large panel surface, and a manufacturing method of it.

The above object can be achieved by a steel sheet for heat shrink band having anhysteretic magnetic permeability of 15,000 or higher at 0.35 Oe and yield stress of 24 kgf/mm$^2$ or more.

The steel sheet for heat shrink band can be manufactured by a method comprising the steps of: hot rolling and/or cold rolling a steel containing 0.01 to 0.15% C by weight; annealing the rolled steel sheet at a temperature ranging from 650 to 900° C.; and temper rolling the annealed steel sheet at a rolling reduction rate of 1.5% or less, or by a method comprising the steps of: hot rolling and/or cold rolling a steel containing 0.01 to 0.15% C by weight; annealing the rolled steel sheet at a temperature ranging from 650 to 900° C.; overaging the annealed steel sheet at a temperature ranging from 250 to 500° C.; and temper rolling the overaged steel sheet at a rolling reduction rate of 1.5% or less.

BEST MODE FOR CARRYING OUT THE INVENTION

Generally, it is known that the magnetization of material after demagnetization in a direct current magnetic field converges to an anhysteretic magnetization (or ideal magnetization) responding to the direct current magnetic field. The slope of the anhysteretic magnetization (magnetic flux density) to the direct current magnetic field is called "anhysteretic magnetic permeability".

We investigated the relationship between geomagnetic shielding performance and anhysteretic magnetic permeability at a direct current bias magnetic field of 0.35 Oe on steel sheets having various kinds of chemical composition. The anhysteretic magnetic permeability was measured in the following procedure.

i) A ring-shaped specimen wound with an excitation coil, a detection coil and a direct current bias magnetic field coil is completely demagnetized by supplying an attenuating alternate current to the excitation coil.

ii) A direct current is supplied to the bias magnetic field coil to generate a direct current magnetic field of 0.35 Oe. In this state, again the attenuating alternate current is supplied to the excitation coil to demagnetizing the specimen.

iii) In a state of applying the bias magnetic field, the B-H loop (hysteresis loop) is measured at the maximum applied field of 40 Oe.

iv) The anhysteretic magnetic permeability is determined from the asymmetry of the B-H loop.

As a result, the following findings are obtained.

1) The anhysteretic magnetic permeability does not necessarily give similar behavior with the magnetic permeability at geomagnetism level which is a normal reference level of evaluation. Geomagnetic shielding performance can be achieved owing to the high anhysteretic magnetic permeability even if the normal magnetic permeability is low. The anhysteretic magnetic permeability of current steel sheets for heat shrink bands ranges from 7000 to 13000.

2) The anhysteretic magnetic permeability has better correlation with the preventive effect of color deviation of cathode ray tubes after alternate current demagnetization, i.e., after the degaussing process, than the normal magnetic permeability.

3) By adopting a steel sheet having anhysteretic magnetic permeability of 15,000 or higher and yield stress of 24 kgf /mm$^2$ or more, the improvement in earth magnetic shielding performance is attained while securing sufficient strength.

4) To increase the anhysteretic magnetic permeability, it is very effective that a steel contains 0.01 to 0.15% C, that the steel is annealed at a temperature ranging from 650 to 900° C., and that the steel is temper rolled at a rolling reduction rate of 1.5% or less (including no temper rolling).

Excessively large coercive force of a steel sheet fails to attain sufficient demagnetization of the steel sheet during the degaussing process, and the magnetization in the direction of geomagnetism fails to reach the anhysteretic magnetization level, which results in degradation of shielding performance. Therefore, considering that the practical maximum magnetism generated by the demagnetization circuit is several Oe, the upper limit of the coercive force is preferably specified to 5 Oe or less. The anhysteretic magnetic permeability has close relation with the magnitude of remanent magnetic flux density. It is desirable for the remanent magnetic flux density to be 10 kG or more in order that the anhysteretic magnetic permeability surely becomes 15,000 or higher.

Different from the ordinary magnetic permeability, the anhysteretic magnetic permeability improves with carbon content. When the carbon content is 0.01% or more, the anhysteretic magnetic permeability always becomes 15,000 or more. If, however, the carbon content exceeds 0.15%, the coercive force tends to exceed 5 Oe, which results in degradation of the magnetic shielding performance. Therefore, the limit of carbon content is preferably specified to 0.01 to 0.15%.

The steel sheet for heat shrink band of the present invention can be manufactured, for example, by hot rolling and/or cold rolling a steel containing 0.01 to 0.15% C by weight, annealing the rolled steel sheet at a temperature ranging from 650 to 900° C., and then temper rolling the annealed steel sheet at a rolling reduction rate of 1.5% or less.

In this case, since residual strain existing in the steel sheet degrades the anhysteretic magnetic permeability, annealing must be executed at a temperature of 650 ° C. or higher. When annealing is executed in $\gamma$ single phase domain, the anhysteretic magnetic permeability becomes lower. Therefore, annealing must be executed at a temperature of 900 °C. or lower, more preferably in $\alpha$ single phase domain.

Normally, annealed steel sheets are subjected to temper rolling at a rolling reduction rate of several percent for shape-correction. When the rolling reduction rate exceeds 1.5%, it becomes extremely difficult to obtain 15,000 or higher anhysteretic magnetic permeability. More preferably, the steel sheet should be subjected to 0% temper rolling, that is, should not be temper rolled.

Compared with the significant degradation of normal magnetic permeability owing to aging, the degradation of anhysteretic magnetic permeability owing to aging is less. However, it is preferred to apply overaging treatment to the annealed steel sheet at a temperature ranging from 250 to 500° C. to completely suppress the degradation of anhysteretic magnetic permeability owing to aging.

The steel sheet for heat shrink band may be plated thereon in view of corrosion resistance. For example, the steel sheet prepared by the above-described method may be subjected to electroplating by a known method. The kinds of plating are not specifically limited, and applicable ones include single layer plating of Zn, Zn—Ni alloy, Ni, Sn, and Cr, or their multilayered plating. The steel sheet may be also prepared by a continuous hot dip plating line having an annealing unit therein. In this case, the kinds of plating applicable include single layer plating of Zn, Zn—Al alloy, and Al, and plating of alloying a part of or all of the plating layer. Furthermore, it is also applicable to form various kinds of chemical coatings on the surface of steel sheet or on the surface of plating layer.

EXAMPLE 1

The testing steels 1 to 7 having the chemical compositions listed in Table 1 were smelted and cast into slabs, and they were subjected to hot rolling and cold rolling in accordance with normal steel making process, to obtain sheets having a thickness of 1.2 mm. Thus prepared sheets were then continuously annealed and overaged under the conditions shown in Table 2.

Thereafter, the measurement of normal magnetic permeability, anhysteretic magnetic permeability, remanent magnetic flux density, coercive force, and yield stress was conducted. The evaluation of these magnetic characteristics was given on ring-shaped specimens to determine the normal magnetic permeability at 0.35 Oe ($\mu$0.35), the remanent magnetic flux density at 10 Oe and the coercive force. The anhysteretic magnetic permeability was measured by the above mentioned method. The yield stress was evaluated using a JIS No.5 test piece.

As seen in Table 2, Examples according to the present invention give 15,000 or higher anhysteretic magnetic permeability, 5 Oe or less coercive force and 10 kG or larger remanent magnetic flux density, having superior geomagnetic shielding performance. And satisfactory yield stress as high as 24 kgf/mm$^2$ or more is obtained to give sufficient strength to heat shrink band.

On the other hand, Comparative Examples give the anhysteretic magnetic permeability of below 15,000, having insufficient geomagnetic shielding performance.

As described above, it is found that the remanent magnetic flux density of 10 kG or larger results in anhysteretic magnetic permeability of 15,000 or higher.

TABLE 1

| | C | Si | Mn | P | S |
|---|---|---|---|---|---|
| Testing steel 1 | 0.0025 | 0.012 | 1.01 | 0.075 | 0.0032 |
| Testing steel 2 | 0.0048 | 0.014 | 0.98 | 0.073 | 0.0035 |
| Testing steel 3 | 0.012 | 0.012 | 0.75 | 0.072 | 0.0038 |
| Testing steel 4 | 0.025 | 0.011 | 0.76 | 0.050 | 0.0036 |
| Testing steel 5 | 0.039 | 0.015 | 0.75 | 0.045 | 0.0033 |
| Testing steel 6 | 0.091 | 0.010 | 0.60 | 0.045 | 0.0033 |
| Testing steel 7 | 0.150 | 0.012 | 0.62 | 0.024 | 0.0041 |

TABLE 2

| Testing steel | Annealing temperature (° C.) | Overaging temperature (° C.) | Magnetic permeability $\mu$ 0.35 | Anhysteretic magnetic permeability | Remanent magnetic flux density (kG) | Coercive force (Oe) | Yield stress (kgf/mm$^2$) | Remark |
|---|---|---|---|---|---|---|---|---|
| 1 | 750 | 350 | 610 | 13200 | 8.9 | 1.65 | 20 | Comparative example |
| 2 | 750 | 350 | 480 | 14500 | 9.6 | 1.76 | 22 | Comparative example |
| 3 | 750 | 350 | 320 | 18300 | 11.2 | 1.98 | 25 | Example |
| | 750 | 450 | 310 | 18500 | 11.3 | 1.99 | 26 | Example |
| 4 | 630 | 350 | 190 | 12000 | 8.2 | 3.02 | 38 | Comparative example |
| | 700 | 350 | 250 | 23800 | 13.1 | 2.88 | 33 | Example |
| | 750 | 350 | 300 | 24100 | 13.1 | 2.72 | 30 | Example |
| | 800 | 350 | 340 | 16800 | 10.6 | 2.68 | 28 | Example |
| | 850 | 350 | 320 | 15400 | 10.3 | 2.45 | 25 | Example |
| | 920 | 350 | 280 | 14800 | 9.8 | 2.75 | 27 | Comparative example |
| 5 | 700 | 350 | 280 | 22600 | 12.4 | 3.51 | 28 | Example |
| | 750 | 350 | 300 | 20500 | 12.4 | 3.51 | 28 | Example |
| 6 | 750 | 350 | 250 | 21300 | 12.0 | 4.45 | 28 | Example |
| 7 | 750 | 350 | 250 | 19300 | 11.7 | 4.86 | 29 | Example |

EXAMPLE 2

The testing steel 4 having the chemical composition listed in Table 1 was hot rolled and cold rolled to a sheet having a thickness of 1.2 mm. Thus prepared sheet was then continuously annealed at 750° C. and overaged at 350° C., followed by being temper rolled at the rolling reduction rates shown in Table 3.

Thereafter, the measurement of normal magnetic permeability, anhysteretic magnetic permeability, remanent magnetic flux density, coercive force, and yield stress was conducted in the same manner as described in the Example 1.

As shown in Table 3, when the rolling reduction rate is not more than 1.5%, the anhysteretic magnetic permeability becomes 15,000 or more, giving sufficient geomagnetic shielding performance. On the other hand, when the rolling reduction rate exceeds 1.5%, the anhysteretic magnetic permeability reduces to below 15,000 to result in poor geomagnetic shielding performance.

TABLE 3

| Rolling reduction rate (%) | Magnetic permeability | Anhysteretic magnetic permeability | Remanet magnetic permeability (kG) | Coercive force (Oe) |
|---|---|---|---|---|
| None | 300 | 24000 | 12.9 | 2.65 |
| 0.50 | 250 | 19800 | 11.6 | 2.82 |
| 1.00 | 210 | 17600 | 10.7 | 2.95 |
| 1.50 | 180 | 15200 | 10.2 | 3.15 |
| 2.00 | 160 | 13200 | 9.3 | 3.24 |
| 2.50 | 150 | 11400 | 8.9 | 3.42 |

What is claimed is:

1. A steel sheet for heat shrink band, having anhysteretic magnetic permeability of 15,000 or higher at 0.35 Oe and yield stress of 24 kgf/mm$^2$ or more.

2. The steel sheet for heat shrink band of claim 1, wherein coercive force thereof is 5 Oe or less and remanent magnetic flux density is 10 kG or larger.

3. The steel sheet for heat shrink band of claim 1, containing 0.01 to 0.15% C by weight.

4. The steel sheet for heat shrink band of claim 2, containing 0.01 to 0.15% C by weight.

5. A method for manufacturing a steel sheet for a heat shrink band of claim 3, comprising the steps of:

(a) hot rolling and/or cold rolling a steel containing 0.01 to 0.15% C by weight;

(b) annealing the rolled steel sheet from step (a) at a temperature ranging from 650 to 900° C.; and (c) temper rolling the annealed steel sheet from step (b) at a rolling reduction rate of 1.5% or less.

6. A method for manufacturing a steel sheet for a heat shrink band of claim 3, comprising the steps of:

(a) hot rolling and/or cold rolling a steel containing 0.01 to 0.15% C by weight;

(b) annealing the rolled steel sheet from step (a) at a temperature ranging from 650 to 900° C.;

(c) overaging the annealed steel sheet from step (b) at a temperature ranging from 250 to 500° C.; and (d) temper rolling the overaged steel sheet from step (c) at a rolling reduction rate of 1.5% or less.

7. A heat shrink band made of the steel sheet of claim 1.

8. A heat shrink, band made of the steel sheet of claim 2.

9. A heat shrink band made of the steel sheet of claim 3.

10. A heat shrink band made of the steel sheet of claim 4.

11. A steel sheet of claim 1, wherein the steel sheet has a composition comprising 0.012 wt % C, 0.012 wt % Si, 0.75 wt % Mn, 0.072 wt % P and 0.0038 wt % S.

12. A steel sheet of claim 1, wherein the steel sheet has a composition comprising 0.039 wt % C, 0.015 wt % Si, 0.75 wt % Mn, 0.045 wt % P and 0.0033 wt % S.

13. A steel sheet of claim 1, wherein the steel sheet has a composition comprising 0.091 wt % C, 0.010 wt % Si, 0.60 wt % Mn, 0.045 wt % P and 0.0033 wt % S.

14. A steel sheet of claim 1, wherein the steel sheet has a composition comprising 0.150 wt % C, 0.012 wt % Si, 0.62 wt % Mn, 0.024 wt % P and 0.0041 wt % S.

* * * * *